US007262750B2

(12) United States Patent
Sun

(10) Patent No.: US 7,262,750 B2
(45) Date of Patent: Aug. 28, 2007

(54) CURRENT-DRIVEN OLED PANEL AND RELATED PIXEL STRUCTURE

(75) Inventor: Wein-Town Sun, Taoyuan County (TW)

(73) Assignee: Au Optronics Corp., Hsin-Chu (TW)

( * ) Notice: Subject to any disclaimer, the term of this patent is extended or adjusted under 35 U.S.C. 154(b) by 107 days.

(21) Appl. No.: 10/906,544

(22) Filed: Feb. 24, 2005

(65) Prior Publication Data

US 2006/0097973 A1 May 11, 2006

(30) Foreign Application Priority Data

Oct. 28, 2004 (TW) ..... 93132762 A

(51) Int. Cl.
*G09G 3/30* (2006.01)

(52) U.S. Cl. ..... 345/76; 345/80; 315/169.3

(58) Field of Classification Search ..... 345/76, 345/92, 80, 55, 204; 315/169.3, 169.4
See application file for complete search history.

(56) References Cited

U.S. PATENT DOCUMENTS 4,477,741 A * 10/1984 Moser, Jr. ..... 326/57
6,091,203 A * 7/2000 Kawashima et al. ..... 315/169.3
6,359,605 B1 * 3/2002 Knapp et al. ..... 345/76
6,580,408 B1 * 6/2003 Bae et al. ..... 345/76
6,753,655 B2 * 6/2004 Shih et al. ..... 315/169.3
2003/0001828 A1 * 1/2003 Asano ..... 345/204
2003/0058231 A1 * 3/2003 Kitaura et al. ..... 345/204
2003/0062941 A1 * 4/2003 Kim et al. ..... 327/218
2003/0085665 A1 * 5/2003 Yoo ..... 315/169.3
2005/0140602 A1 * 6/2005 Shin et al. ..... 345/76

* cited by examiner

*Primary Examiner*—Douglas W. Owens
*Assistant Examiner*—Ephrem Alemu
(74) *Attorney, Agent, or Firm*—Winston Hsu

(57) ABSTRACT

A display apparatus includes a light-emitting device, a first scan line for transferring a first signal to select the light-emitting device, a data line for transferring a data current signal to drive the light-emitting device, a first transistor having a gate coupled to the first scan line for selecting the light-emitting device according to the first signal, and a current mirror electrically connected to the light-emitting device for transferring a driving current signal to drive the light-emitting device. The current mirror includes a second transistor having a gate coupled to the data line and one of the source and the drain of the first transistor for receiving the data current signal. In addition, the current mirror further includes a third transistor having a gate coupled to the other of the source and the drain of the first transistor for transferring the driving current signal.

37 Claims, 9 Drawing Sheets

CURRENT-DRIVEN OLED PANEL AND RELATED PIXEL STRUCTURE

BACKGROUND OF INVENTION

1. Field of the Invention

The invention relates to a display apparatus and its pixel structure, and more particularly, to a current-driven organic light emitting diode (OLED) display apparatus and its pixel structure.

2. Description of the Prior Art

Referring to FIG. 1, which is a diagram of a conventional pixel 10 of a voltage-driven OLED display apparatus. As shown in FIG. 1, the pixel 10 comprises a scan line SL, a data line DL, a thin-film transistor (TFT) M1, a thin-film transistor M2, a capacitor C, and an organic light emitting diode (OLED). The gate of the TFT M1 is connected to the scan line SL, the drain of TFT M1 is connected to the data line DL, and the source of the TFT M1 is connected to the gate of the TFT M2 and the capacitor C. The drain of the TFT M2 is connected to the organic light emitting diode (OLED), and the source of the TFT M2 is connected to the capacitor and a voltage source Vdd. Furthermore, the organic light emitting diode (OLED) is connected to another voltage source Vss.

In addition, the operation of the pixel 10 is illustrated as follows. First of all, an external gate driver (not shown) drives the scan line SL and supplies a predetermined voltage to the scan line, the predetermined voltage is transferred to the gate of the TFT M1 through the scan line SL, and the TFT M1 is utilized as a switch. Therefore, the TFT M1 is turned on. In addition, the voltage information carried by the data line DL can be transferred to the gate of the TFT M2 and the capacitor C through the TFT M1. Please note that the voltage information carried by the data line DL is set by the external data driver (not shown) according to the display data (for example, a gray value of the pixel 10) to be displayed of the pixel 10.

And then, because the above-mentioned voltage information is utilized to control the gate voltage of the TFT M2, the TFT M2 can determine the current I, which passes through the TFT M2, according to the voltage information. On the other hand, because the luminace of the organic light emitting diode (OLED) is directly proportional to the current I, the organic light emitting diode (OLED) generates a corresponding amount of light according to the current I, and the pixel 10 is driven.

As shown in FIG. 1, the capacitor C is utilized to store the above-mentioned voltage information. When the voltage information passes through the TFT M1, the voltage information is not only utilized as the gate voltage of the TFT M2 for turning on the TFT M2, but also affects the charges stored in the capacitor C. Therefore, when the capacitor C stores enough charges for maintaining the voltage level corresponding to the above-mentioned voltage information, the gate driver and the data driver can stop driving the pixel 10. And then the capacitor C can be utilized to continuously drive the TFT M2 to make the TFT M2 output the current I for a predetermined time interval. Furthermore, because the capacitor C is utilized to drive the TFT M2, noise from data line DL no longer affects the TFT M2. Therefore, this can make the organic light emitting diode (OLED) stably generate light. In other words, the pixel 10 can stably output a wanted gray value.

However, inaccuracies in manufacturing the TFT M2 (for example, an inaccurate doping concentration or an inaccurate distance between the gate and the substrate) may occur. This may cause an inaccuracy of the threshold voltage of the TFT M2 or an inaccuracy of the mobility of the TFT M2. These inaccuracies may directly affect the current I. Therefore, even if the same voltage information is utilized, currents I of different pixels are still different. In other words, this makes different pixels having the same voltage information display with different luminance values.

SUMMARY OF INVENTION

The present invention has been made in view of the above-mentioned problems, and has an object of providing a current-driven OLED display apparatus and its pixel structure.

According to an exemplary embodiment of the present invention, a pixel structure is disclosed. The pixel comprises: a light-emitting device; a first scan line for transferring a first signal; a data line for transferring a data current signal; a first transistor having a gate coupled to the first scan line; and a current mirror electrically connected to the light-emitting device. The current mirror comprises: a second transistor having a gate connected to the data line and one of the source and the drain of the first transistor; and a third transistor having a gate coupled to the other of the source and the drain of the first transistor.

Furthermore, a pixel structure having an electro-luminescent diode and a capacitor is disclosed. The pixel structure comprises: a voltage source; a first transistor having a gate coupled to a scan line; a second transistor having a gate coupled to a data line and one of the source and the drain of the first transistor; a third transistor having a gate coupled to the other of the source and the drain of the first transistor, one of the source and the drain of the third transistor being coupled to the electro-luminescent diode, and the other of the source and the drain of the third transistor being coupled to the voltage source; and a fourth transistor having a gate coupled to the scan line, one of the source and the drain of the fourth transistor being coupled to the data line; wherein the other of the source and the drain of the fourth transistor is coupled to one of the source and the drain of the second transistor, and the gate of the second transistor is coupled to the gate of the third transistor through the first transistor to form a current mirror.

The present invention pixel utilizes the current-driven theorem so that the present invention pixel has better display stability. Furthermore, the present invention pixel can stably display a wanted gray-value luminance.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
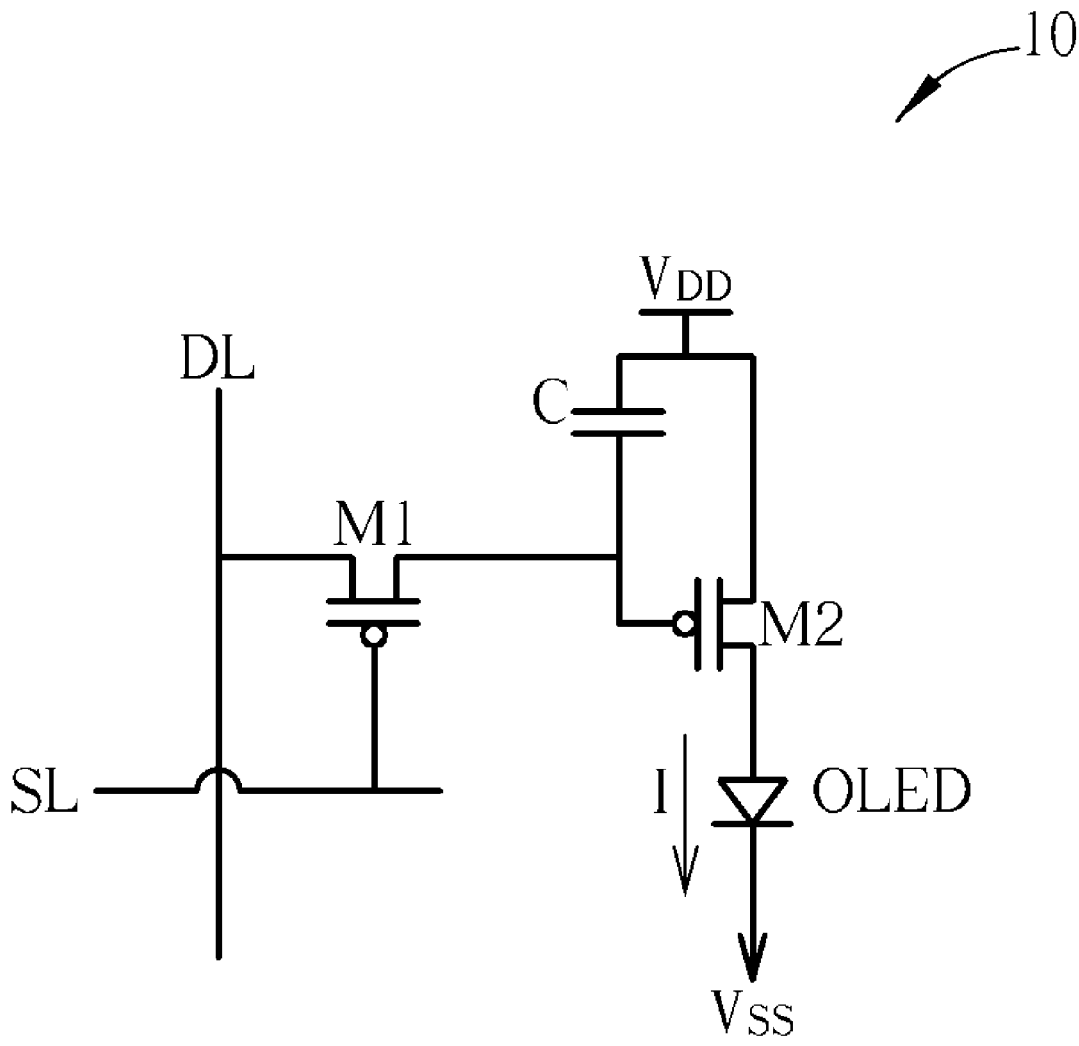
Fig. 1 Prior art
FIG. 1 is a diagram of a conventional pixel of a voltage-driven OLED display apparatus.
Figure 2:
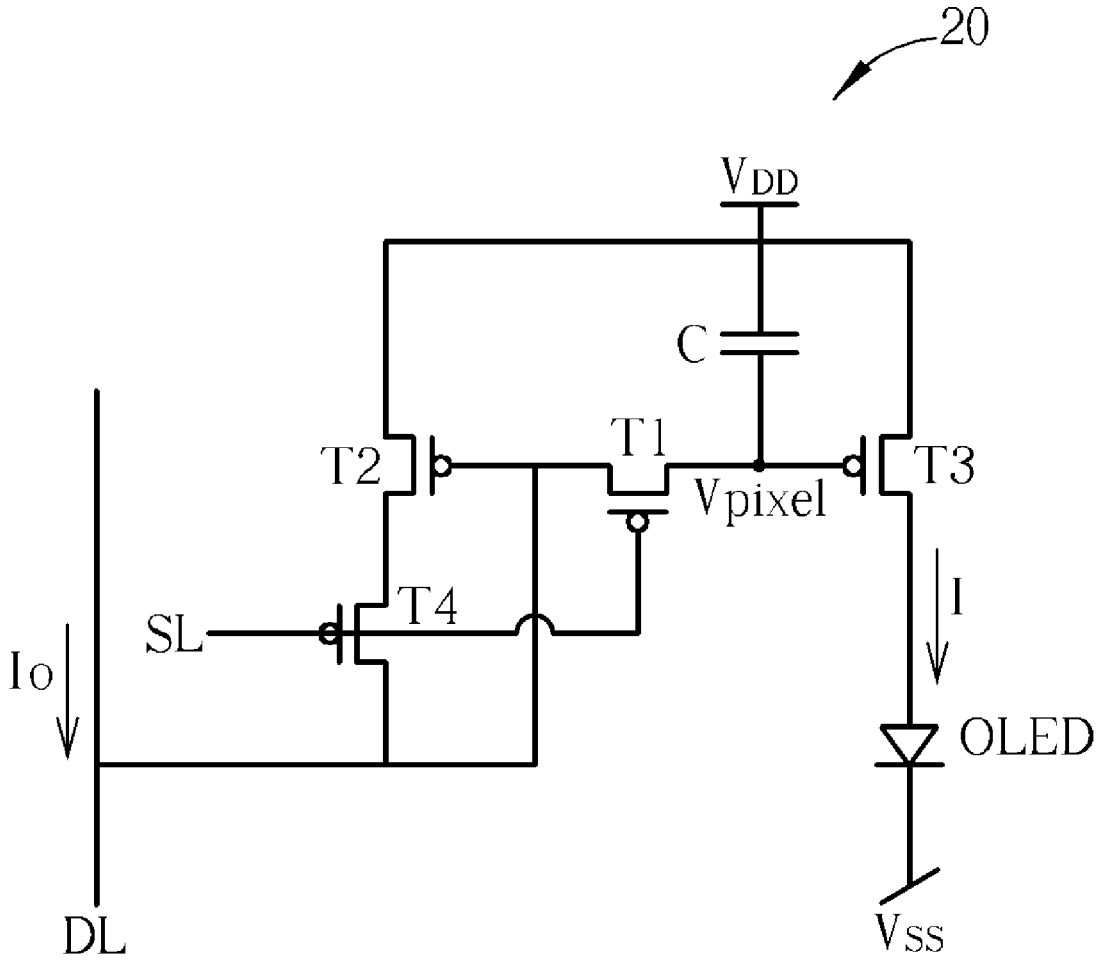
FIG. 2 is a diagram of a pixel in a current-driven LED display apparatus of a first embodiment of the present invention.

Referring to FIG. 2, which is a diagram of a pixel 20 in a current-driven light emitting diode (LED) display apparatus of a first embodiment of the present invention. Please note that as an example, the LED described is an organic light-emitting diode. As shown in FIG. 2, the pixel 20 comprises a scan line SL, a data line DL, a capacitor C, a plurality of TFTs T1, T2, T3, and T4, and an organic light emitting diode (OLED). Please note that the devices having the same name as those described previously (for example, the scan line SL, the data line DL, the capacitor C, and the organic light emitting diode (OLED)) have the same functions and operations, and thus the description is not repeated here. As shown in FIG. 2, the TFTs T2, and T3 are mainly utilized to form a current mirror. It is well-known that the current mirror can drive the current I to pass through the TFT T3 corresponding to the current $I_0$, wherein the ratio of the current I to the current $I_0$ is the current ratio of the current mirror. Furthermore, the TFTs T1 and T4 are utilized as two switches. Simply speaking, when the current mirror operates, the gates of the TFTs T2 and T3 have to be coupled to each other and the TFT T2 has to be coupled to the data line DL through the TFT T4. In this embodiment, the gate of the TFT T1 is coupled to the scan line SL, the source of the TFT T1 is coupled to the gate of the TFT T3 and the capacitor C, and the drain of the TFT T1 is coupled to the gate of the TFT T2 and the data line DL. Furthermore, the source of the TFT T3 is coupled to a voltage source Vdd, and the drain of the TFT T3 is coupled to the organic light emitting diode (OLED). In addition, the source of the TFT T2 is coupled to the voltage source Vdd, and the drain of the TFT T2 is coupled to the source of the TFT T4. The gate of the TFT T4 is coupled to the scan line SL, and the drain of the TFT T4 is coupled to the data line DL. Furthermore, the capacitor C is connected to the voltage source, and the organic light emitting diode (OLED) is connected to another voltage source Vss.

Figure 3:
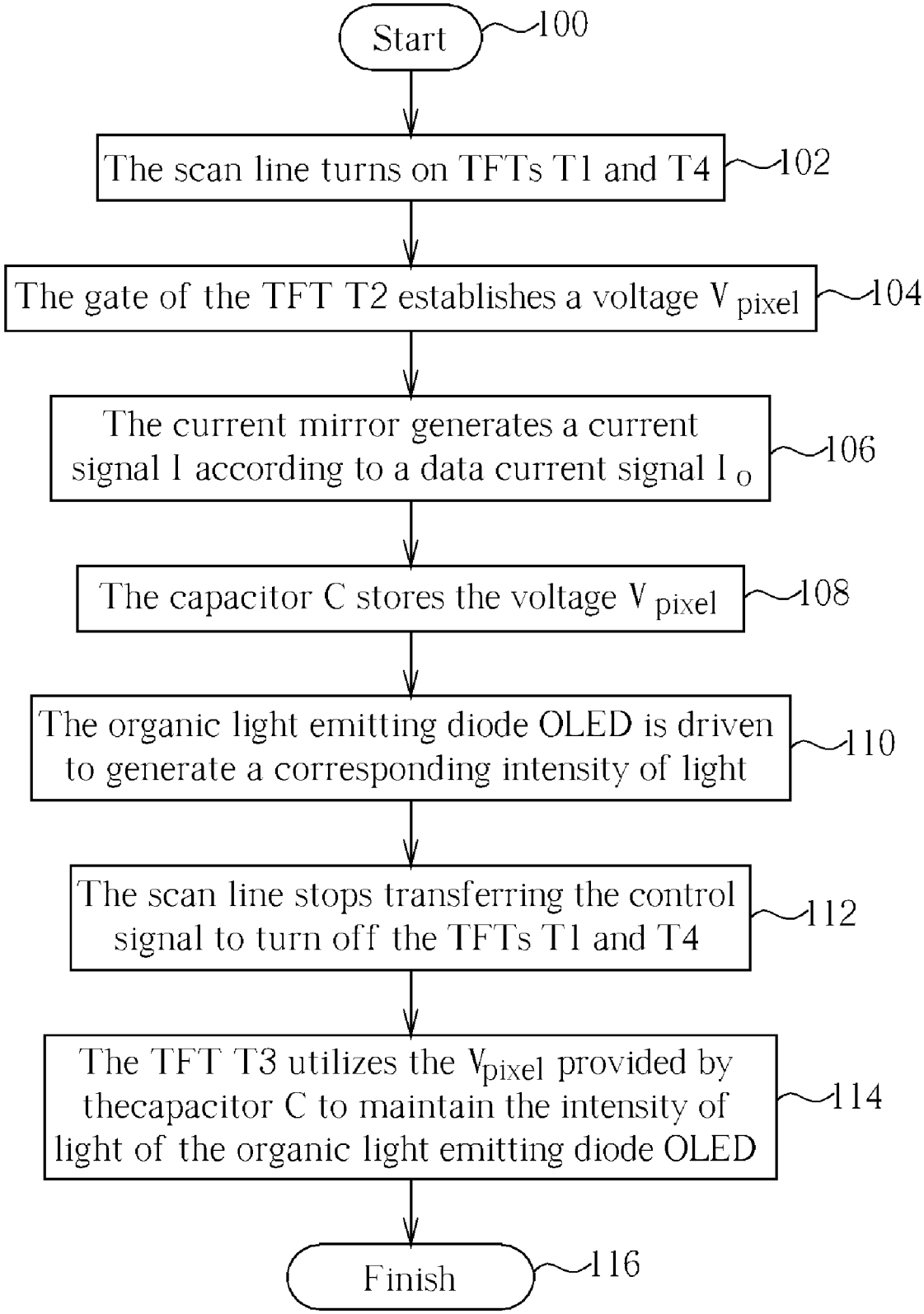
FIG. 3 is a flow diagram of an operation of driving the pixel shown in FIG. 2.

Referring to FIG. 3, which is a flow diagram of an operation of driving the pixel 20 shown in FIG. 2. In the following illustration, taking the current-driven LED for an example with the LED being an OLED, the operation of driving the pixel 20 comprises following steps:

Step 100: Start;

Step 102: The scan line SL transfers a signal to the gates of the TFTs T1 and T4 for turning on the TFTs T1 and T4;

Step 104: The gate of the TFT T2 establishes a voltage $V_{pixel}$ according to the data current signal $I_0$ outputted by the data line DL;

Step 106: The current mirror generates the current signal I according to the data current signal $I_0$;

Step 108: The capacitor C stores the voltage $V_{pixel}$;

Step 110: The current I drives the organic light emitting diode (OLED) to generate a corresponding intensity of light;

Step 112: The scan line SL stops transferring the signal so that the TFTs T1 and T4 are no longer turned on;

Step 114: The TFT T3 utilizes the voltage $V_{pixel}$ stored in the capacitor C to generate the current signal I in order to maintain the intensity of light generated by the organic light emitting diode (OLED); and Step 116: The operation of driving the pixel 20 completes.

At first, in a write stage, the scan line SL transfers a signal to the gates of the TFTs T1 and T4 to turn on the TFTs T1 and T4 (step 102). Therefore, the TFT T4 can be regarded as being conductive. The data current signal $I_0$ of the data line DL can pass through the TFT T2. Therefore, the gate of the TFT T2 generates a corresponding $V_{pixel}$ according to the data current signal $I_0$ (step 104). Furthermore, because the TFT T1 can also be regarded as being conductive, the voltage $V_{pixel}$ is transferred to the capacitor C and the TFT T3.

And then, because of the characteristic of the current mirror, the current mirror generates a current signal I according to the data current signal $I_0$, wherein the ratio of the current signal I to the data current signal $I_0$ is the current ratio (generally speaking, the current ratio is substantially equal to $(W/L)_{T2}$: $(W/L)_{T3}$, wherein the W/L is a ratio of the width to the length of the channel of the TFT) (step 106). Furthermore, the capacitor C maintains the above-mentioned voltage $V_{pixel}$ so that the voltage difference between two terminals of the capacitor C is $Vdd-V_{pixel}$ (step 108). At the same time, the current signal I passe through the organic light emitting diode (OLED) so that the organic light emitting diode (OLED) generates a corresponding intensity of light (step 110). After step 110, the write stage completes.

And then, the reproducing stage starts. At this time, the scan line SL stops transferring the signal to turn off the TFTs T1 and T4 (step 112). Therefore, the TFTs T1 and T4 can be regarded as being non-conductive. As mentioned above, the capacitor C maintains the voltage difference as $Vdd-V_{pixel}$. Furthermore, the capacitor C cannot discharge after the TFT T1 is turned off. Therefore, the gate of the TFT T3 can maintain the voltage $V_{pixel}$, and the TFT T3 can generate a stable current signal I because of the voltage $V_{pixel}$. The organic light emitting diode (OLED) can generate stable light corresponding to the current I (step 114). Here, the driving operation of the pixel 20 completes (step 116).

Figure 4:
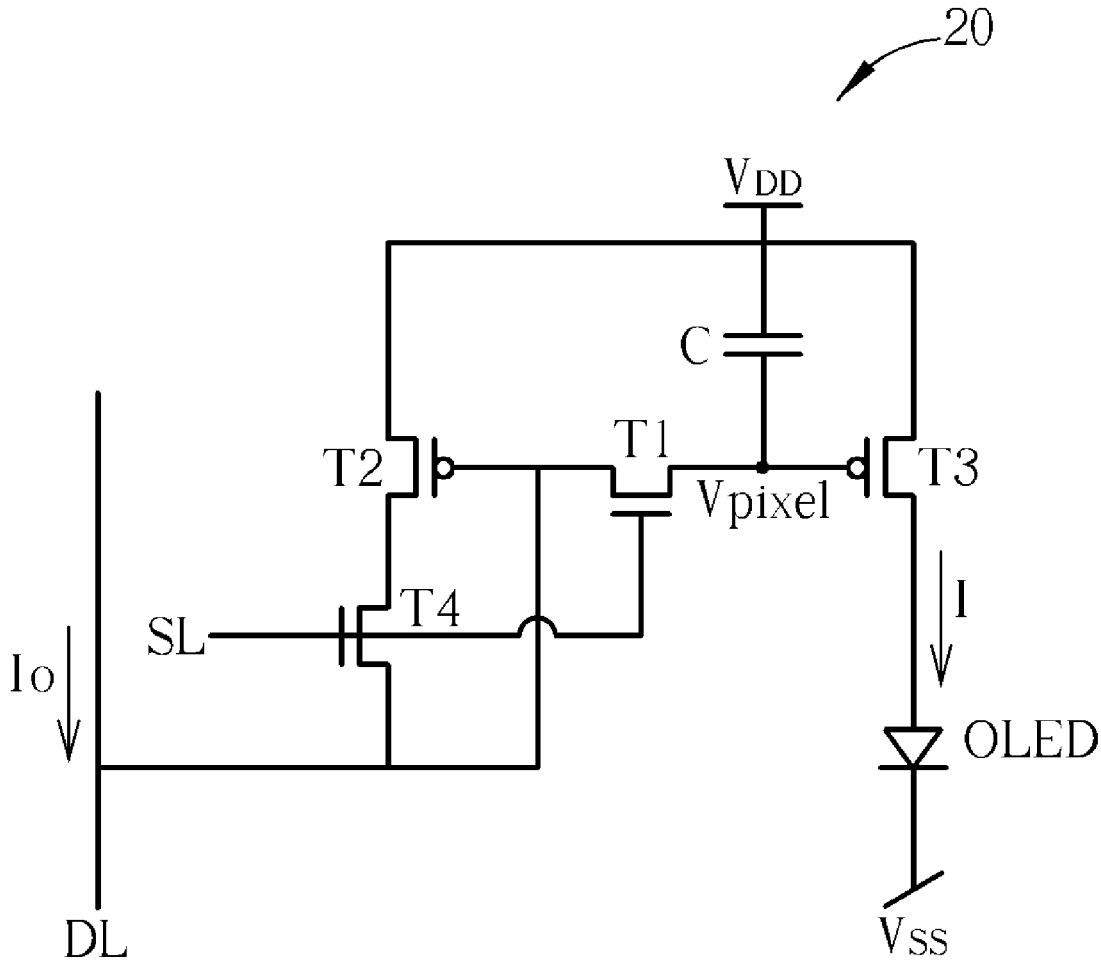
FIG. 4 is a diagram of a pixel in FIG. 2 of a second embodiment of the present invention.
Figure 5:
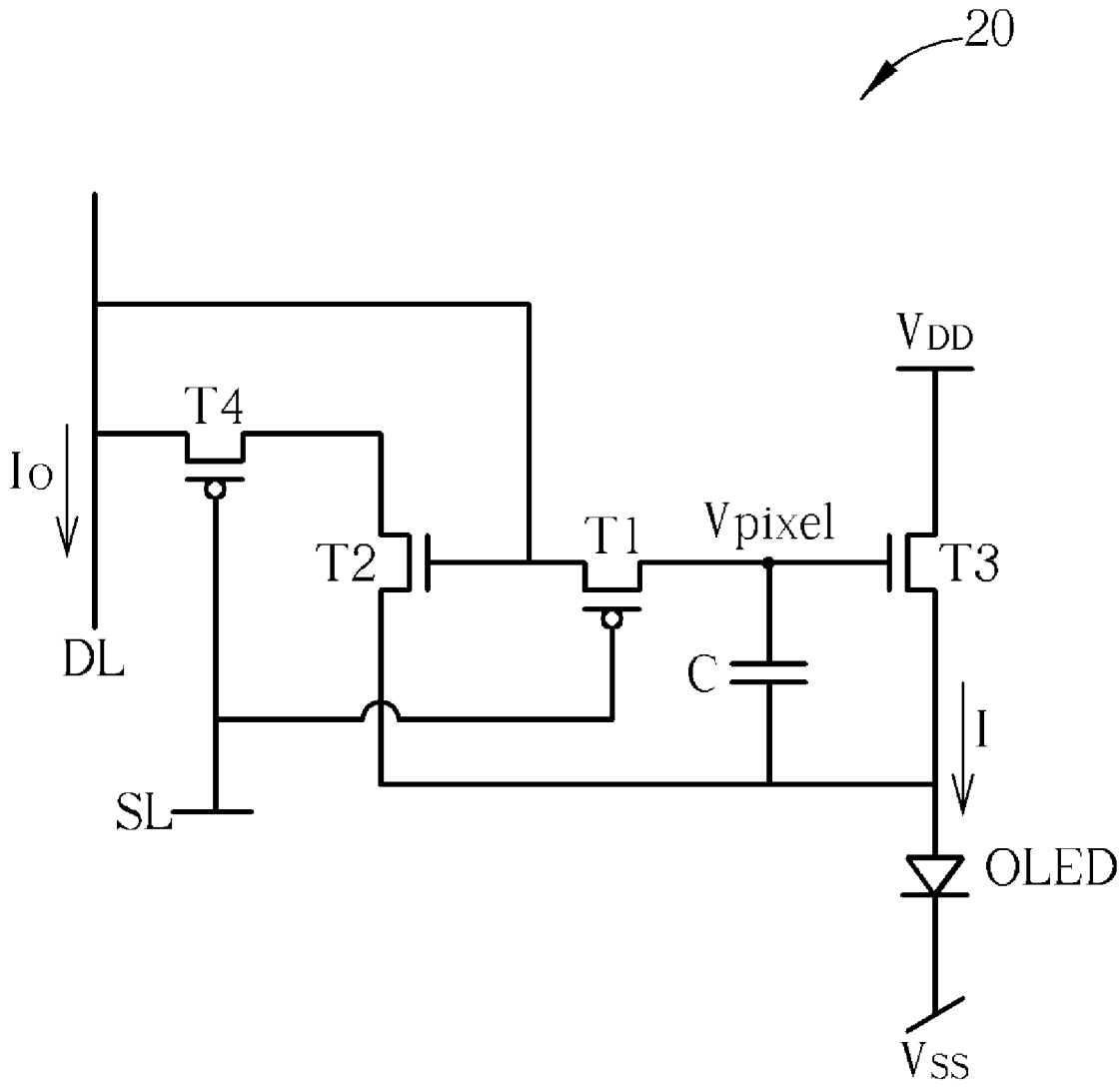
FIG. 5 is a diagram of a pixel in FIG. 2 of a third embodiment of the present invention.
Figure 6:
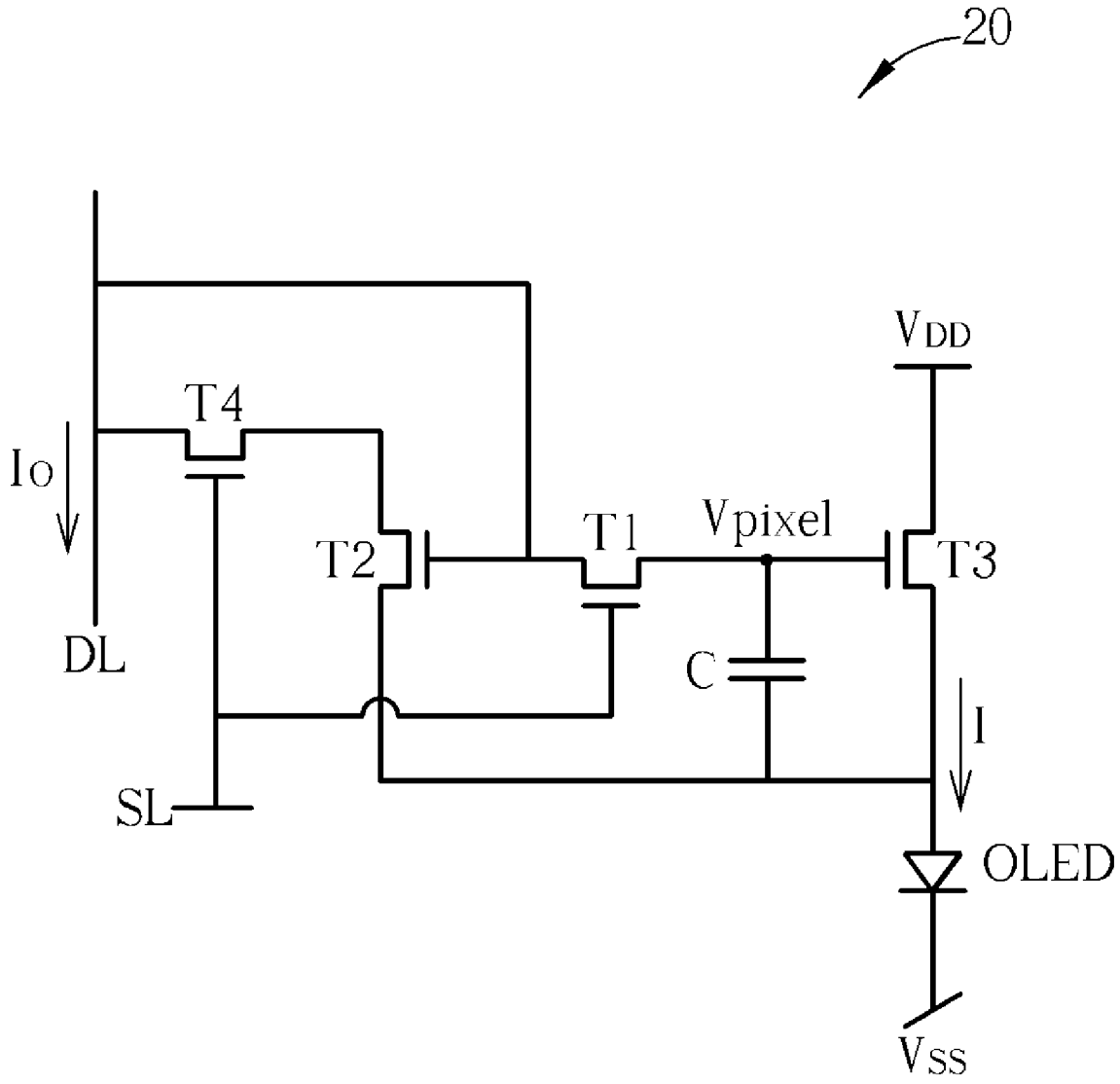
FIG. 6 is a diagram of a pixel in FIG. 2 of a fourth embodiment of the present invention.

Please note that in FIG. 2, the pixel 20 comprises 4 P-type TFTs. In fact, N-type TFTs can be utilized, also. This is also consistent with the original intention of the present invention. Referring to FIG. 4, FIG. 5, and FIG. 6. FIG. 4 are a diagram of a pixel shown in FIG. 2 of a second embodiment of the present invention. In contrast to the first embodiment shown in FIG. 2, in the embodiment shown in FIG. 4, the TFTs T1 and T4, which are utilized as switches, are implemented by N-type TFTs. Here, the operation and function of the N-type and P-type TFT are well-known, and thus omitted.

FIG. 5 is a diagram of a pixel 20 shown in FIG. 2 of a third embodiment of the present invention. FIG. 6 is a diagram of a pixel 20 shown in FIG. 2 of a fourth embodiment of the present invention. As shown in FIG. 5, the pixel 20 utilizes a N-type TFT to be the current mirror. And the operation steps are illustrated as follows:

First, in the above-mentioned write stage, the scan line SL transfers a signal to the gates of the TFTs T1 and T4 to turn on the TFTs T1 and T4, and TFT T4 can be regarded as being conductive. Therefore, the data current signal $I_0$ of the data line DL can pass through the TFT T2, and the gate of the TFT T2 generates a corresponding voltage $V_{pixel}$ according to the data current signal $I_0$. Furthermore, because the TFT T1 can be regarded as being conductive, the voltage $V_{pixel}$ is transferred to the capacitor C and the TFT T3.

And then, because of the characteristic of the current mirror, the current mirror generates a current signal I according to the data current signal $I_0$, wherein the ratio of the current signal I to the data current signal $I_0$ is the current ratio. Furthermore, the capacitor C maintains the above-mentioned voltage $V_{pixel}$ to keep the voltage difference between the two terminals of the capacitor C at a predetermined value. Simultaneously, the current signal I can pass through the organic light emitting diode (OLED) so that the organic light emitting diode (OLED) generates a corresponding intensity of light. Here, the write stage completes.

And then, the reproducing stage starts. At this time, the scan line SL stops transferring the signal to turn off the TFTs T1 and T4, and the TFTs T1 and T4 can be regarded as being non-conductive. Because the capacitor C maintains the voltage difference between the two terminals of the capacitor C and the capacitor C cannot discharge because the TFT T1 is turned off, the capacitor C can maintain the voltage difference between the gate and the source of the TFT T3. Therefore, the TFT T3 can maintain the current signal I so that the organic light emitting diode (OLED) can maintain the generated light. Here, the driving operation of the pixel 20 completes.

Referring to FIG. 6. As shown in FIG. 6, all TFTs of the pixel 20 are N-type TFTs. In contrast to the pixel 20 shown in FIG. 5, the pixel 20 shown in FIG. 6 only comprises two N-type TFTs T1 and T4 as switches. Here, the operation and the functions of the N-type and P-type TFTs are well-known. In addition, other operations of the pixel 20 shown in FIG. 6 are similar to the pixel 20 shown in FIG. 5, and are thus omitted here.

Figure 7:
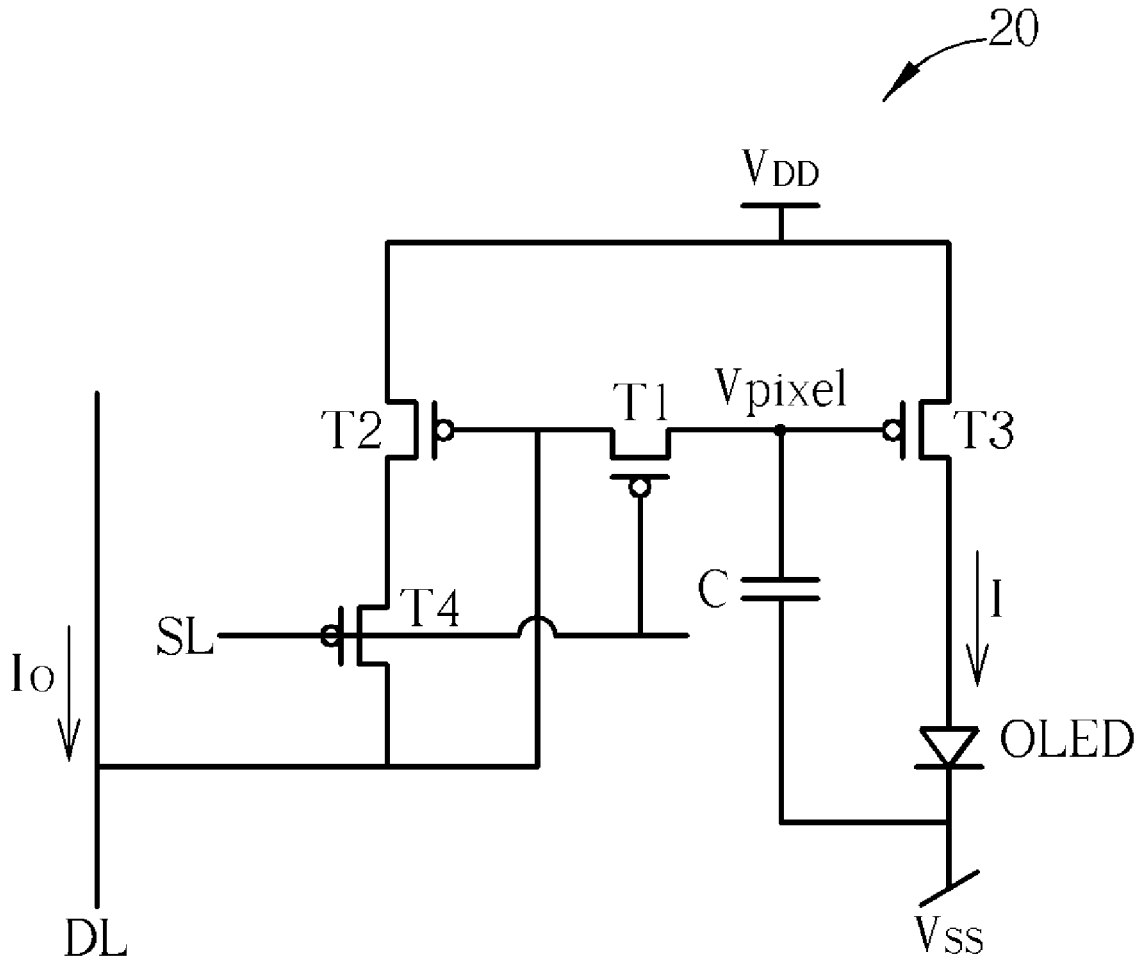
FIG. 7 is a diagram of a pixel in FIG. 2 of a fifth embodiment of the present invention.
Figure 8:
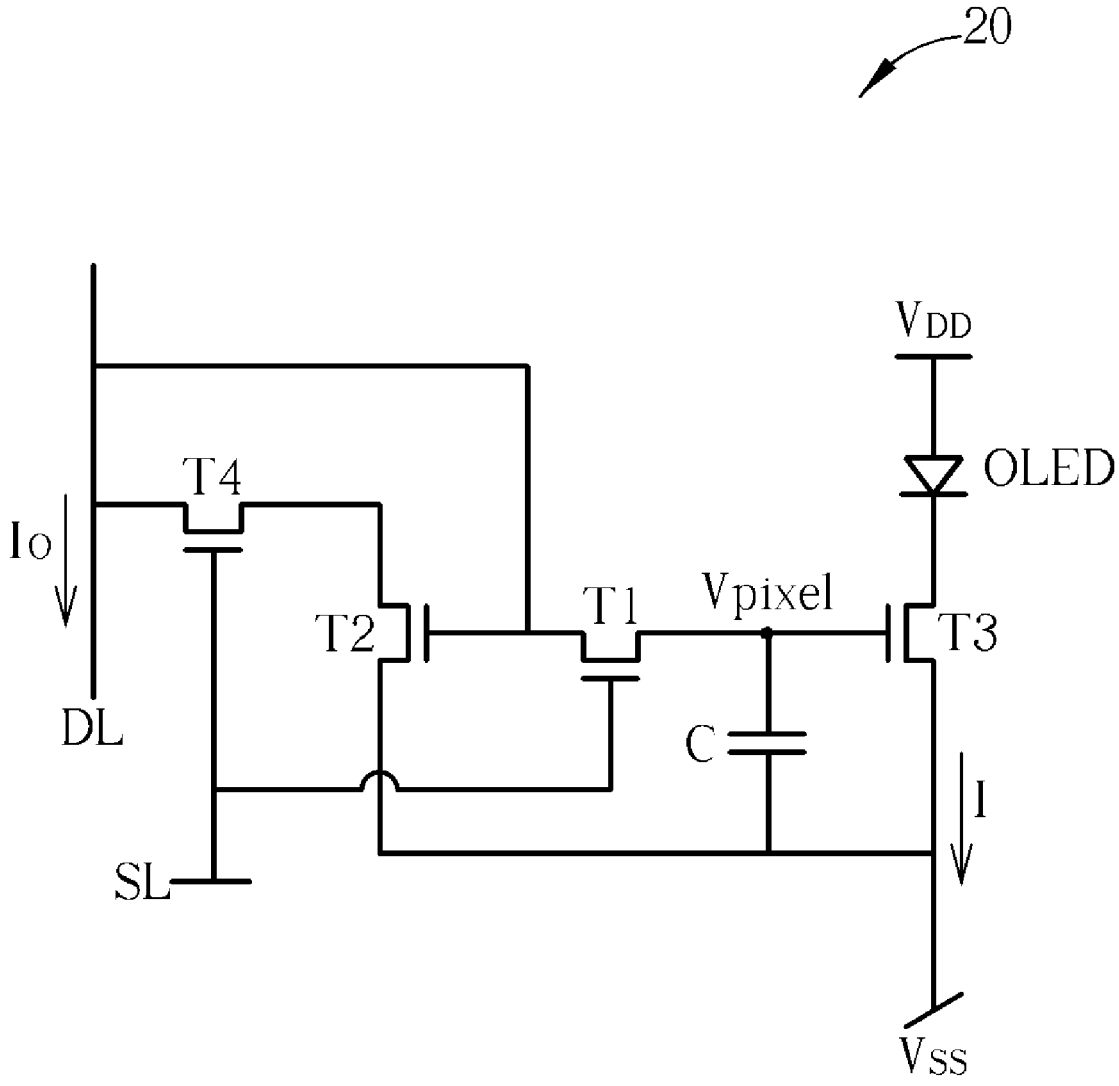
FIG. 8 is a diagram of a pixel in FIG. 2 of a sixth embodiment of the present invention.

Furthermore, Referring to FIG. 7, which is a diagram of a pixel 20 shown in FIG. 2 of a fifth embodiment of the present invention. As shown in FIG. 7, the connection of the capacitor C is not limited to being connected between the voltage source Vdd and the gate of the TFT T3. In this embodiment, the capacitor C is coupled between the gate of the TFT T3 and another voltage source Vss. Therefore, the capacitor C maintains the voltage difference between the two terminals of the capacitor C as $V_{pixel}$−Vss. That is, the capacitor C also achieves the purpose of maintaining the gate voltage of the TFT T3 as the voltage $V_{pixel}$. Referring to FIG. 8, which is a diagram of a pixel 20 shown in FIG. 2 of a sixth embodiment of the present invention. In this embodiment, the position of the organic light emitting diode (OLED) changes. That is, the organic light emitting diode (OLED) is coupled between the voltage source Vdd and the TFT T3. Because the current signal I passes through the TFT T3 (from the voltage source Vdd to the voltage source Vss), as long as the organic light emitting diode (OLED) is placed in the path of the current signal I, the current signal can drive the organic light emitting diode (OLED) to generate wanted light.

Figure 9:
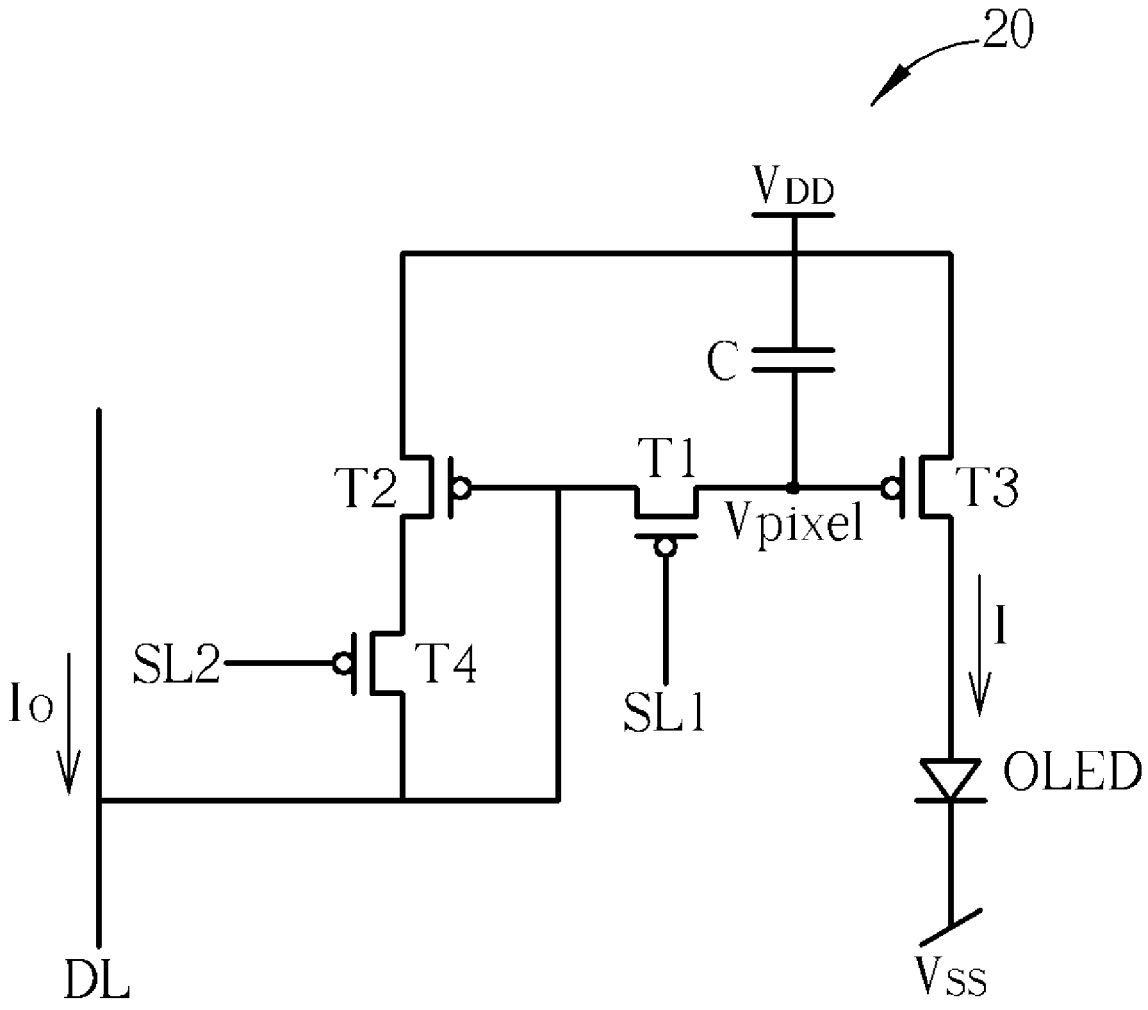
FIG. 9 is a diagram of a pixel in FIG. 2 of a seventh embodiment of the present invention.

Referring to FIG. 9 in conjunction with FIG. 2. FIG. 9 is a diagram of a pixel 20 shown in FIG. 2 of a seventh embodiment of the present invention. The difference between the first embodiment shown in FIG. 2 and the seventh embodiment shown in FIG. 9 is the number of scan lines. In this embodiment, the TFTs T1 and T4 are controlled by two scan lines SL1 and SL2, respectively. This can reduce the feed-through effect on the voltage $V_{pixel}$ of the capacitor C. The feed-through effect is caused because the TFTs T1 and T4 switch. Therefore, two scan lines SL1 and SL2 are utilized in this embodiment. In other words, when the TFT T4 has not been turned on yet, the scan line SL1 can first transfer the signal to turn on the TFT T1. And when the TFT T1 has not been turned off, the scan line SL2 can first transfer the signal to turn off the TFT T4.

Please note that in the pixel 20 of the present invention, the gate of the TFT T2 is electrically connected to the data line DL. Therefore, in the above-mentioned write stage, this structure can help the pixel quickly write the gate voltage of the TFT T2. That is, when the scan line SL turns on the TFTs T1 and T4, the wanted gate voltage $V_{pixel}$ of the TFT T2 can be quickly established. Therefore, the present invention pixel 20 has better response speed.

In addition, in contrast to the prior art, the present invention pixel utilizes the current-driven theorem so that the present invention pixel has better display stability. Furthermore, the present invention pixel can stably display a wanted gray-value luminance.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A pixel structure, comprising:

a light-emitting device;

a first scan line for transferring a first signal;

a data line for transferring a data current signal;

a first transistor having a gate coupled to the first scan line;

a current mirror electrically connected to the light-emitting device, the current mirror comprising:

a second transistor having a gate connected to the data line and one of the source and the drain of the first transistor; and a third transistor having a gate coupled to the other of the source and the drain of the first transistor; and a fourth transistor having a gate coupled to the first scan line, one of the source and the drain of the fourth transistor being electrically connected to the drain of the second transistor, and the other of the source and the drain of the fourth transistor being electrically connected to the gate of the second transistor and the data line.

2. A display apparatus comprising a pixel structure of claim 1.

3. A pixel structure having an electro-luminescent diode and a capacitor, comprising:

a voltage source;

a scan line;

a data line;

a first transistor having a gate coupled to the scan line;

a second transistor having a gate coupled to the data line and one of the source and the drain of the first transistor;

a third transistor having a gate coupled to the other of the source and the drain of the first transistor, one of the source and the drain of the third transistor being coupled to the electro-luminescent diode, and the other of the source and the drain of the third transistor being coupled to the voltage source; and a fourth transistor having a gate coupled to the scan line, one of the source and the drain of the fourth transistor being coupled to the data line;

wherein the other of the source and the drain of the fourth transistor is coupled to one of the source and the drain of the second transistor, the gate of the second transistor is coupled to the gate of the third transistor through the first transistor to form a current mirror, and the other of the source and the drain of the second transistor is coupled to the light-emitting device.

4. A display apparatus comprising a pixel structure of claim 3.

5. A pixel structure having an electro-luminescent diode and a capacitor, comprising:

a voltage source;

a first scan line;

a second scan line;

a data line;

a first transistor having a gate coupled to the first scan line;

a second transistor having a gate coupled to the data line and one of the source and the drain of the first transistor;

a third transistor having a gate coupled to the other of the source and the drain of the first transistor, one of the source and the drain of the third transistor being coupled to the electro-luminescent diode, and the other of the source and the drain of the third transistor being coupled to the voltage source; and a fourth transistor having a gate coupled to the second scan line, one of the source and the drain of the fourth transistor being coupled to the data line;

wherein the other of the source and the drain of the fourth transistor is coupled to one of the source and the drain of the second transistor, the gate of the second transistor is coupled to the gate of the third transistor through the first transistor to form a current mirror, and the other of the source and the drain of the second transistor is coupled to the light-emitting device.

6. A display apparatus comprising a pixel structure of claim 5.

7. A pixel structure, comprising:

a light-emitting device;

a first scan line for transferring a first signal;

a second scan line for transferring a second signal;

a data line for transferring a data current signal;

a first transistor having a gate coupled to the first scan line;

a current mirror electrically connected to the light-emitting device, the current mirror comprising:

a second transistor having a gate connected to the data line and one of the source and the drain of the first transistor; and a third transistor having a gate coupled to the other of the source and the drain of the first transistor; and a fourth transistor having a gate coupled to the second scan line, one of the source and drain of the fourth transistor being electrically connected to the drain of the second transistor, and the other of the source and drain of the fourth transistor being electrically connected to the gate of the second transistor and the data line.

8. The pixel structure of claim 1, wherein the first transistor and the fourth transistor are both N-type thin film transistors (TFTs) or both P-type TFTs.

9. The pixel structure of claim 1, wherein the second transistor and the third transistor are both N-type TFTs or both P-type TFTs.

10. The pixel structure of claim 1, wherein the light-emitting device is an electro-luminescent diode.

11. A display apparatus comprising a pixel structure of claim 1.

12. A pixel structure having an electro-luminescent diode and a capacitor, comprising:

a voltage source;

a scan line;

a data line;

a first transistor having a gate coupled to the scan line;

a second transistor having a gate coupled to the data line and one of the source and the drain of the first transistor, wherein the gate of the second transistor is directly connected to the data line;

a third transistor having a gate coupled to the other of the source and the drain of the first transistor, one of the source and the drain of the third transistor being coupled to the electro-luminescent diode, and the other of the source and the drain of the third transistor being coupled to the voltage source; and a fourth transistor having a gate coupled to the scan line, one of the source and the drain of the fourth transistor being coupled to the data line;

wherein the other of the source and the drain of the fourth transistor is coupled to one of the source and the drain of the second transistor, and the gate of the second transistor is coupled to the gate of the third transistor through the first transistor to form a current mirror.

13. The pixel structure of claim 12, wherein the other of the source and the drain of the second transistor is coupled to the light-emitting device.

14. The pixel structure of claim 12, wherein the other of the source and the drain of the second transistor is coupled to the voltage source.

15. The pixel structure of claim 12, wherein the capacitor is coupled between the voltage source and the gate of the third transistor.

16. The pixel structure of claim 12, wherein the capacitor is coupled between the gate of the third transistor and one of the gate of the third transistor and one of the source and the drain of the second transistor.

17. The pixel structure of claim 12, wherein the first transistor and the fourth transistor are both N-type TFTs or both P-type TFTs.

18. The pixel structure of claim 12, wherein the second transistor and the third transistor are both N-type TFTs or both P-type TFTs.

19. A display apparatus comprising a pixel structure of claim 12.

20. A pixel structure having an electro-luminescent diode and a capacitor, comprising:

a voltage source;

a first scan line;

a second scan line;

a data line;

a first transistor having a gate coupled to the first scan line;

a second transistor having a gate coupled to the data line and one of the source and the drain of the first transistor, wherein the gate of the second transistor is directly connected to the data line;

a third transistor having a gate coupled to the other of the source and the drain of the first transistor, one of the source and the drain of the third transistor being coupled to the electro-luminescent diode, and the other of the source and the drain of the third transistor being coupled to the voltage source; and a fourth transistor having a gate coupled to the second scan line, one of the source and the drain of the fourth transistor being coupled to the data line;

wherein the other of the source and the drain of the fourth transistor is coupled to one of the source and the drain of the second transistor, and the gate of the second transistor is coupled to the gate of the third transistor through the first transistor to form a current mirror.

21. The pixel structure of claim 20, wherein the other of the source and the drain of the second transistor is coupled to the light-emitting device.

22. The pixel structure of claim 20, wherein the other of the source and the drain of the second transistor is coupled to the voltage source.

23. The pixel structure of claim 20, wherein the capacitor is coupled between the voltage source and the gate of the third transistor.

24. The pixel structure of claim 20, wherein the capacitor is coupled between the gate of the third transistor and one of the gate of the third transistor and one of the source and the drain of the second transistor.

25. The pixel structure of claim 20, wherein the first transistor and the fourth transistor are both N-type TFTs or both P-type TFTs.

26. The pixel structure of claim 20, wherein the second transistor and the third transistor are both N-type TFTs or both P-type TFTs.

27. A display apparatus comprising a pixel structure of claim 20.

28. A method of driving a pixel structure having a capacitor, a voltage source, a scan line, a data line, a gate of a first transistor coupled to the scan line, a gate of a second transistor coupled to the data line and one of the source and the drain of the first transistor, the gate of the second transistor directly connected to the data line, a gate of a third transistor coupled to the other of the source and the drain of the first transistor, one of the source and the drain of the third transistor coupled to an electro-luminescent diode and the other of the source and the drain of the third transistor coupled to the voltage source, a gate of a fourth transistor coupled to the scan line, and one of the source and the drain of the fourth transistor coupled to the data line and the other of the source and the drain of the fourth transistor coupled to one of the source and the drain of the second transistor, and the gate of the second transistor coupled to the gate of the third transistor through the first transistor, thereby forming a current mirror, the method comprising:

turning on the first transistor and the fourth transistor according to the scan line, thereby enabling the current mirror to drive the light-emitting device according to the data line and driving the capacitor to store a specific voltage according to the data line; and turning off the first transistor and the fourth transistor according to the scan line to thereby disable the current mirror, and keeping driving the light-emitting device through the third transistor turned on according to the specific voltage provided by the capacitor.

29. A method of driving a pixel structure having a first scan line for transferring a first signal, a data line for transferring a data current signal, a gate of a first transistor coupled to the first scan line, a current mirror coupled to a light-emitting device, wherein the current mirror includes a second transistor having a gate connected to the data line and one of the source and the drain of the first transistor and a third transistor having a gate coupled to the other of the source and the drain of the first transistor, a gate of a fourth transistor coupled to the first scan line, one of the source and the drain of the fourth transistor coupled to the drain of the second transistor, and the other of the source and the drain of the fourth transistor coupled to the gate of the second transistor and the data line, the method comprising:

turning on the first transistor and the fourth transistor according to the first signal on the first scan line, thereby enabling the current mirror to drive the light-emitting device according to the data current signal; and turning off the first transistor and the fourth transistor according to the first signal on the first scan line, thereby disabling the current mirror.

30. A method of driving a pixel structure having a capacitor, a voltage source, a scan line, a data line, a gate of a first transistor coupled to the scan line, a gate of a second transistor coupled to the data line and one of the source and the drain of the first transistor, a gate of a third transistor coupled to the other of the source and the drain of the first transistor, one of the source and the drain of the third transistor coupled to an electro-luminescent diode and the other of the source and the drain of the third transistor to the voltage source, a gate of a fourth transistor coupled to the scan line, and one of the source and the drain of the fourth transistor coupled to the data line and the other of the source and the drain of the fourth transistor coupled to one of the source and the drain of the second transistor, and the gate of the second transistor to the gate of the third transistor through the first transistor, thereby forming a current mirror, the other of the source and the drain of the second transistor coupled to the light-emitting device, the method comprising:

turning on the first transistor and the fourth transistor according to the scan line, thereby enabling the current mirror to drive the light-emitting device according to the data line and driving the capacitor to store a specific voltage according to the data line; and turning off the first transistor and the fourth transistor according to the scan line to thereby disable the current mirror, and keeping driving the light-emitting device through the third transistor turned on according to the specific voltage provided by the capacitor.

31. A method of driving a pixel structure having a capacitor, a voltage source, a first scan line, a second scan line, a data line, a gate of a first transistor coupled to the first scan line, a gate of a second transistor coupled to the data line and one of the source and the drain of the first transistor, a gate of a third transistor coupled to the other of the source and the drain of the first transistor, one of the source and the drain of the third transistor coupled to an electro-luminescent diode, and the other of the source and the drain of the third transistor coupled to the voltage source, a gate of a fourth transistor coupled to the second scan line, one of the source and the drain of the fourth transistor coupled to the data line, and the other of the source and the drain of the fourth transistor to one of the source and the drain of the second transistor, and the gate of the second transistor coupled to the gate of the third transistor through the first transistor, thereby forming a current mirror, the other of the source and the drain of the second transistor coupled to the light-emitting device, the method comprising:

turning on the first transistor according to the first scan line and turning on the fourth transistor according to the second scan line, thereby enabling the current mirror to drive the light-emitting device according to the data current signal and driving the capacitor to store a specific voltage according to the data line; and turning off the first transistor according to the first scan line and turning off the fourth transistor according to the second scan line to thereby disable the current mirror, and keeping driving the light-emitting device through the third transistor turned on according to the specific voltage provided by the capacitor.

32. A method of driving a pixel structure having a first scan line for transferring a first signal, a second scan line for transferring a second signal, a data line for transferring a data current signal, a gate of a first transistor coupled to the first scan line, a current mirror coupled to a light-emitting device, wherein the current mirror includes a second transistor having a gate connected to the data line and one of the source and the drain of the first transistor and a third transistor having a gate coupled to the other of the source and the drain of the transistor, and a gate of a fourth transistor coupled to the second scan line, one of the source and drain of the fourth transistor coupled to the drain of the second transistor and the other of the source and drain of the fourth transistor coupled to the gate of the second transistor and the data line, the method comprising:

turning on the first transistor according to the first signal on the first scan line and turning on the fourth transistor according to the second signal on the second scan line, thereby enabling the current mirror to drive the light-emitting device according to the data current signal; and turning off the transistor according to the first signal on the first scan line and turning off the fourth transistor according to the second signal on the second signal on the second scan line, thereby disabling the current mirror.

33. The method of claim 32, wherein the step of turning on the first transistor according to the first signal on the first scan line and turning on the fourth transistor according to the second signal on the second scan line comprises:

turning on the first transistor according to the first signal; and after the first transistor is turned on, turning on the fourth transistor according to the second signal.

34. The method of claim 32, wherein the step of turning off the first transistor according to the first signal on the first scan line and turning off the fourth transistor according to the second signal on the second scan line comprises:

turning off the fourth transistor aaccording to the second signal; and after the fourth transistor is turned off, turning off the first transistor according to the first signal.

35. A method of driving a pixel structure having a capacitor, a voltage source, a first scan line, a second scan line, a data line, a gate of a first transistor coupled to the first scan line, a gate of a second transistor coupled to the data line and one of the source and the drain of the first transistor, the gate of the second transistor directly connected to the data line, a gate of a third transistor coupled to the other of the source and the drain of the first transistor, one of the source and the drain of the third transistor coupled to an electro-luminescent diode, and the other of the source and the drain of the third transistor coupled to the voltage source, a gate of a fourth transistor coupled to the second scan line, one of the source and the drain of the fourth transistor coupled to the data line, and the other of the source and the drain of the fourth transistor to one of the source and the drain of the second transistor, and the gate of the second transistor coupled to the gate of the third transistor through the first transistor, thereby forming a current mirror, the method comprising:

turning on the first transistor according to the first scan line and turning on the fourth transistor according to the second scan line, thereby enabling the current mirror to drive the light-emitting device according to the data current signal and driving the capacitor to store a specific voltage according to the data line; and turning off the first transistor according to the first scan line and turning off the fourth transistor according to the second scan line, thereby enabling the current mirror, and keeping driving the light-emitting device through the third transistor turned on according to the specific voltage provided by the capacitor.

36. The method of claim 35, wherein the step of turning on the first transistor according to the first scan line and turning on the fourth transistor according to the second scan line comprises:

turning on the first transistor according to the first scan line; and after the first transistor is turned on, turning on the fourth transistor according to the second line.

37. The method of claim 35, wherein the step of turning off the first transistor according to the first scan line and turning off the fourth transistor according to the second scan line comprises:

turning off the fourth transistor according to the second scan line; and after the fourth transistor is turned off, turning off the first transistor according to the first scan line.

* * * * *